US010184471B2

(12) United States Patent
Kim et al.

(10) Patent No.: US 10,184,471 B2
(45) Date of Patent: Jan. 22, 2019

(54) TROCHOID PUMP FOR TRANSFERRING HIGH-VISCOSITY LIQUID UNDER HIGH PRESSURE

(71) Applicant: SHINHANG CO., LTD., Gyeonggi-do (KR)

(72) Inventors: Hee Kyun Kim, Gyeonggi-do (KR); Boon Do Eom, Gyeonggi-do (KR)

(73) Assignee: SHINHANG CO., LTD., Gyeonggi-Do (KR)

( * ) Notice: Subject to any disclaimer, the term of this patent is extended or adjusted under 35 U.S.C. 154(b) by 188 days.

(21) Appl. No.: 15/105,775

(22) PCT Filed: Sep. 2, 2014

(86) PCT No.: PCT/KR2014/008201
§ 371 (c)(1),
(2) Date: Jun. 17, 2016

(87) PCT Pub. No.: WO2015/105256
PCT Pub. Date: Jul. 16, 2015

(65) Prior Publication Data

US 2017/0002810 A1 Jan. 5, 2017

(30) Foreign Application Priority Data

Jan. 9, 2014 (KR) ..... 10-2014-0002999

(51) Int. Cl.
*F04C 2/08* (2006.01)
*F04C 2/10* (2006.01)
*F04C 15/00* (2006.01)

(52) U.S. Cl.
CPC ..... *F04C 2/084* (2013.01); *F04C 2/086* (2013.01); *F04C 2/102* (2013.01);
(Continued)

(58) Field of Classification Search
CPC .. F04C 15/0023; F04C 2240/30; F04C 2/086; F04C 2/102
See application file for complete search history.

(56) References Cited

U.S. PATENT DOCUMENTS 6,568,929 B2 * 5/2003 Takagi ..... F04C 2/102 418/171
9,765,777 B2 * 9/2017 Rosenkranz ..... F04C 15/0023
(Continued)

FOREIGN PATENT DOCUMENTS

CN 102652225 A 8/2012
DE 102004028127 A1 * 1/2005 ..... F04C 2/102
(Continued)

OTHER PUBLICATIONS

Translation of International Search Report, Patent Application No. PCT/KR2014/008201, dated Nov. 24, 2014.
(Continued)

*Primary Examiner* — Mary A Davis
(74) *Attorney, Agent, or Firm* — The Dobrusin Law Firm, P.C.

(57) ABSTRACT

Disclosed is a trochoid pump for transferring high-viscosity liquids under high pressure. The trochoid pump includes an idler coupled to an inner through-hole inside a housing to be rotated, a rotor inserted into an inside of the idler, and a shaft configured to rotate the rotor, wherein the idler is provided with an inner toothed groove, into which the rotor is inserted and which has a plurality of projecting teeth, and recessed grooves, which are recessed with a predetermined depth along an outer circumferential surface thereof in a circumferential direction. Unlike an existing gear pump or trochoid pump, the trochoid pump for transferring high-viscosity liquids can reduce a viscous friction force, and can reduce the driving power.

4 Claims, 9 Drawing Sheets

(52) U.S. Cl.
CPC ..... *F04C 15/0073* (2013.01); *F04C 15/0023* (2013.01); *F04C 2240/56* (2013.01); *F04C 2240/60* (2013.01)

(56) References Cited

U.S. PATENT DOCUMENTS

| | | | | |
|---|---|---|---|---|
| 2010/0290941 | A1* | 11/2010 | Honda | F04C 2/102 418/206.1 |
| 2014/0314608 | A1* | 10/2014 | Honda | F04C 2/102 418/191 |
| 2016/0146205 | A1* | 5/2016 | Isoda | F04C 2/102 92/177 |

FOREIGN PATENT DOCUMENTS

| | | | | | |
|---|---|---|---|---|---|
| JP | 03-023678 | A | | 3/1991 | |
| JP | 2003-176790 | A | | 6/2003 | |
| JP | 2008-157175 | A | | 7/2008 | |
| JP | 2008157175 | A | * | 7/2008 | F04C 2/102 |
| JP | 2010-053785 | A | | 3/2010 | |
| KR | 10-0964517 | B1 | | 6/2010 | |

OTHER PUBLICATIONS

Chinese Office Action for Application No. 201480021139.2 dated Jul. 25, 2016.
Written Opinion, Patent Application No. PCT/KR2014/008201, dated Nov. 24, 2014.
Korean Decision to Grant Patent, Patent Application No. 10-2014-0002999 dated Oct. 17, 2014.
Korean Office Action, Patent Application No. 10-2014-0002999, dated Jul. 28, 2014.

* cited by examiner

[Fig. 1]
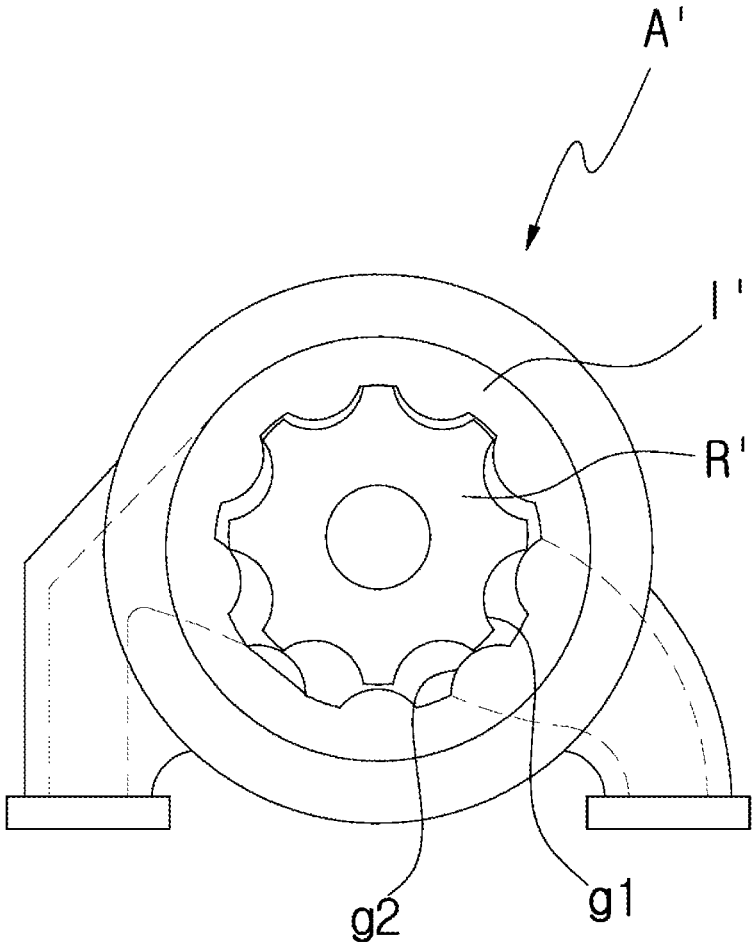
Prior Art

[Fig. 2]
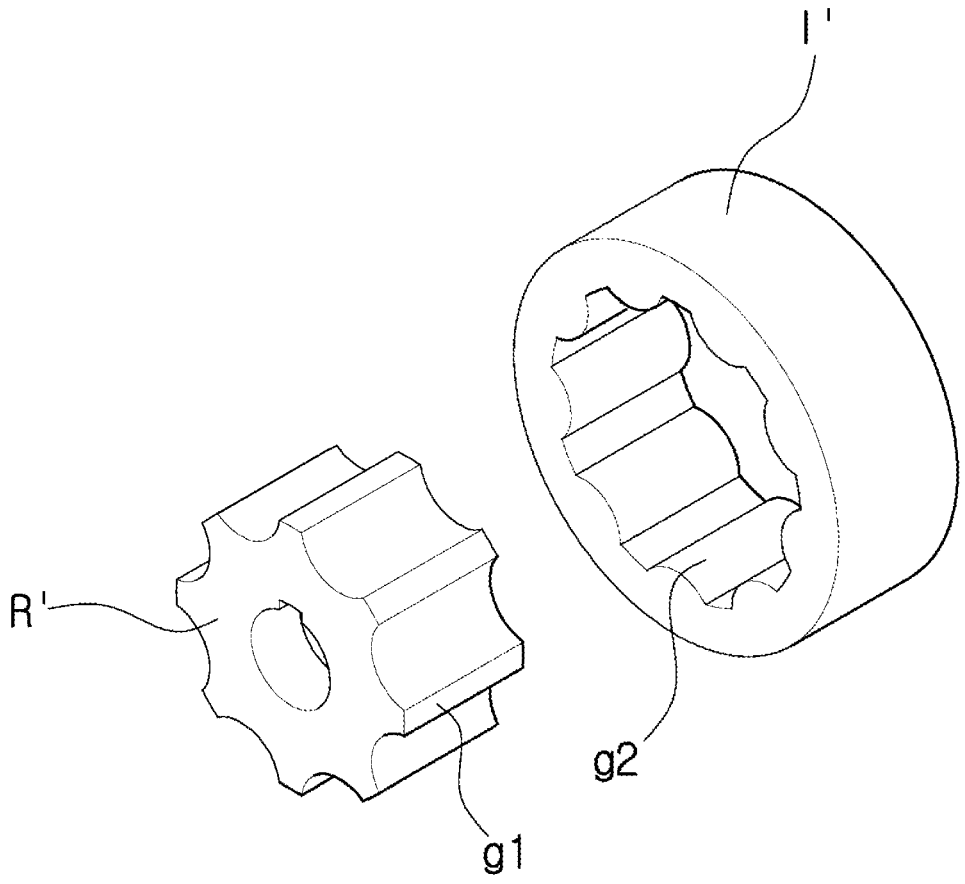
Prior Art

【Fig. 3】
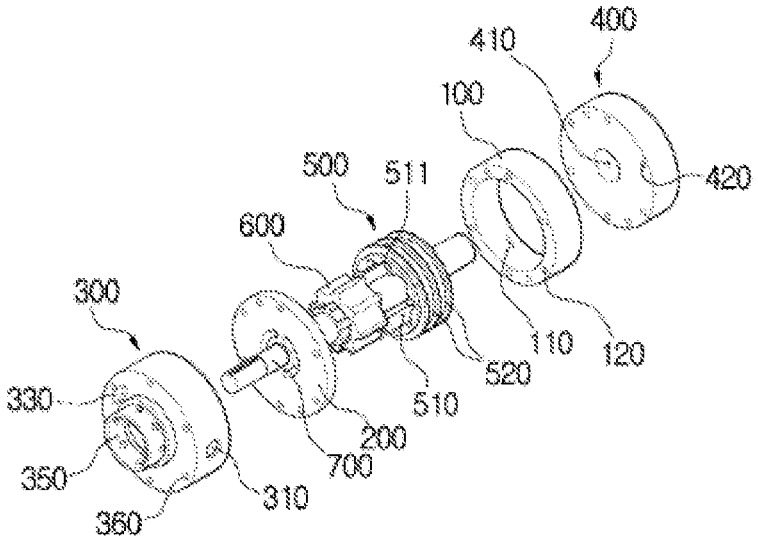

【Fig. 4】
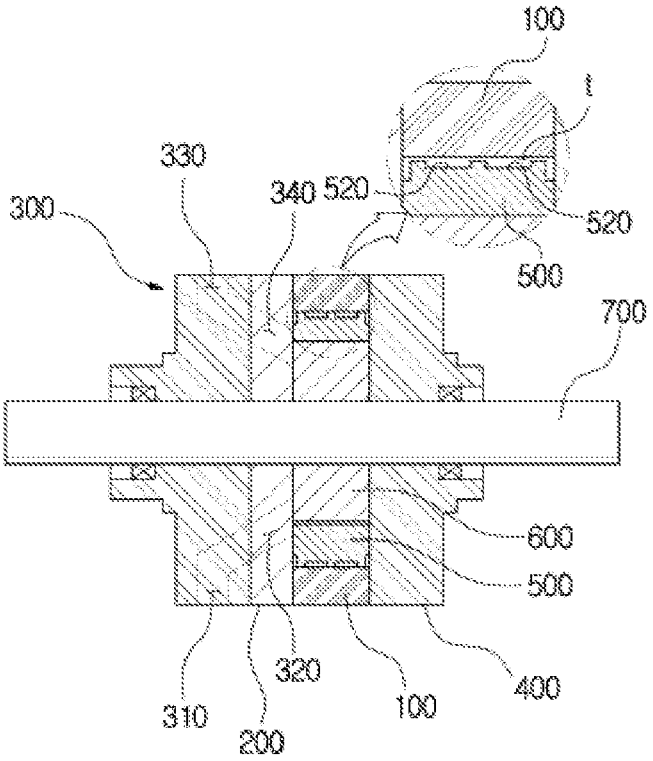

【Fig. 5】
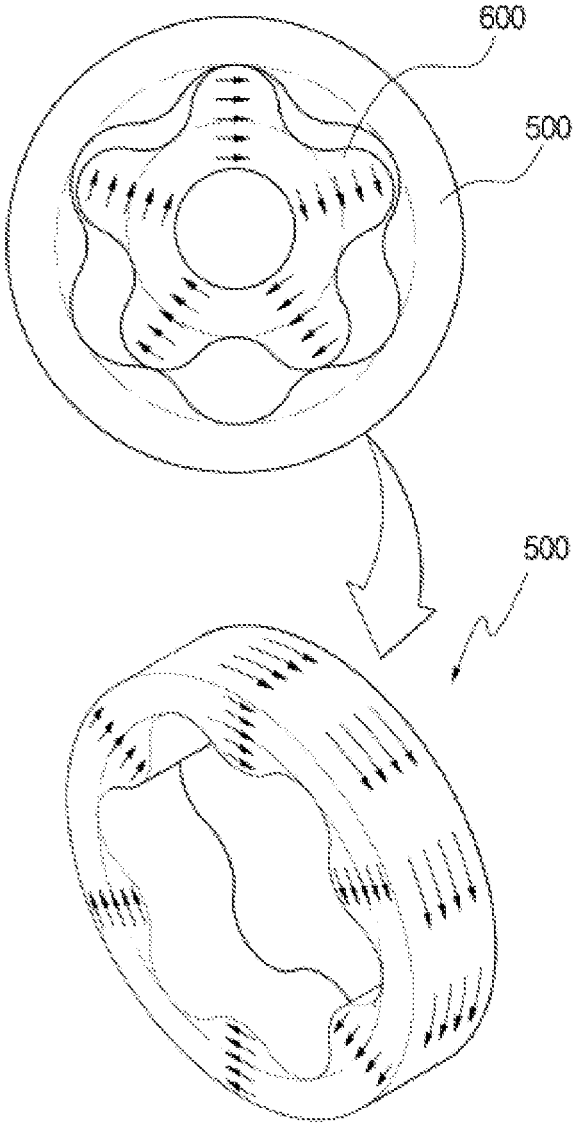

【Fig. 6】
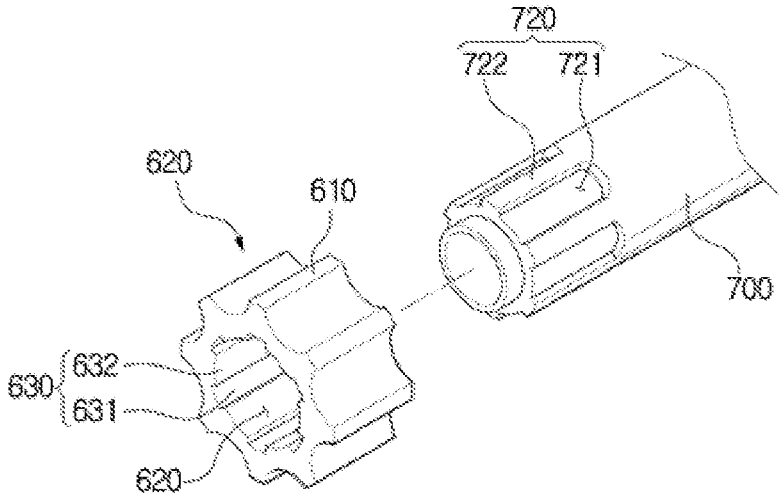

【Fig. 7】
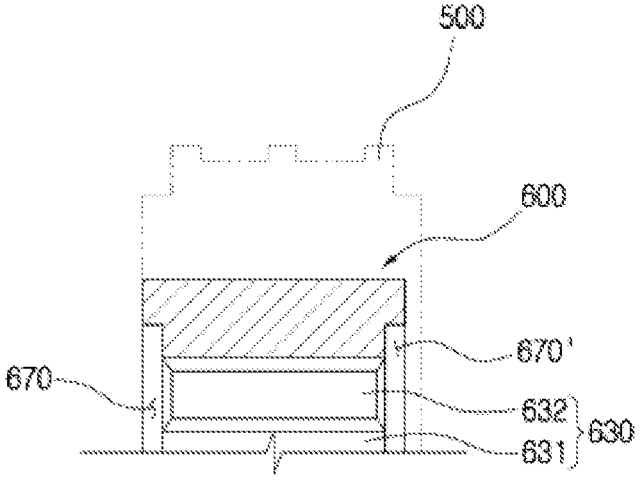

【Fig. 8】
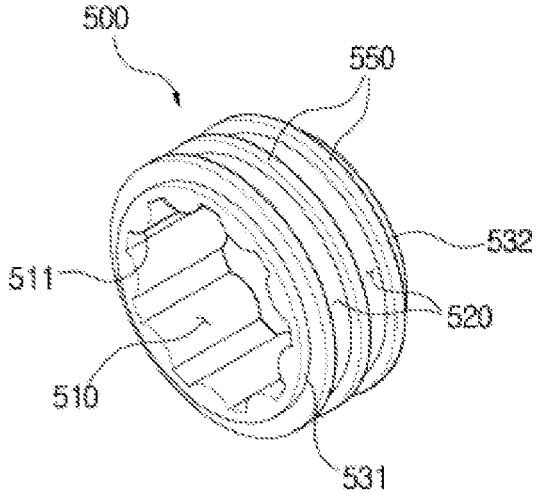

[Fig. 9]
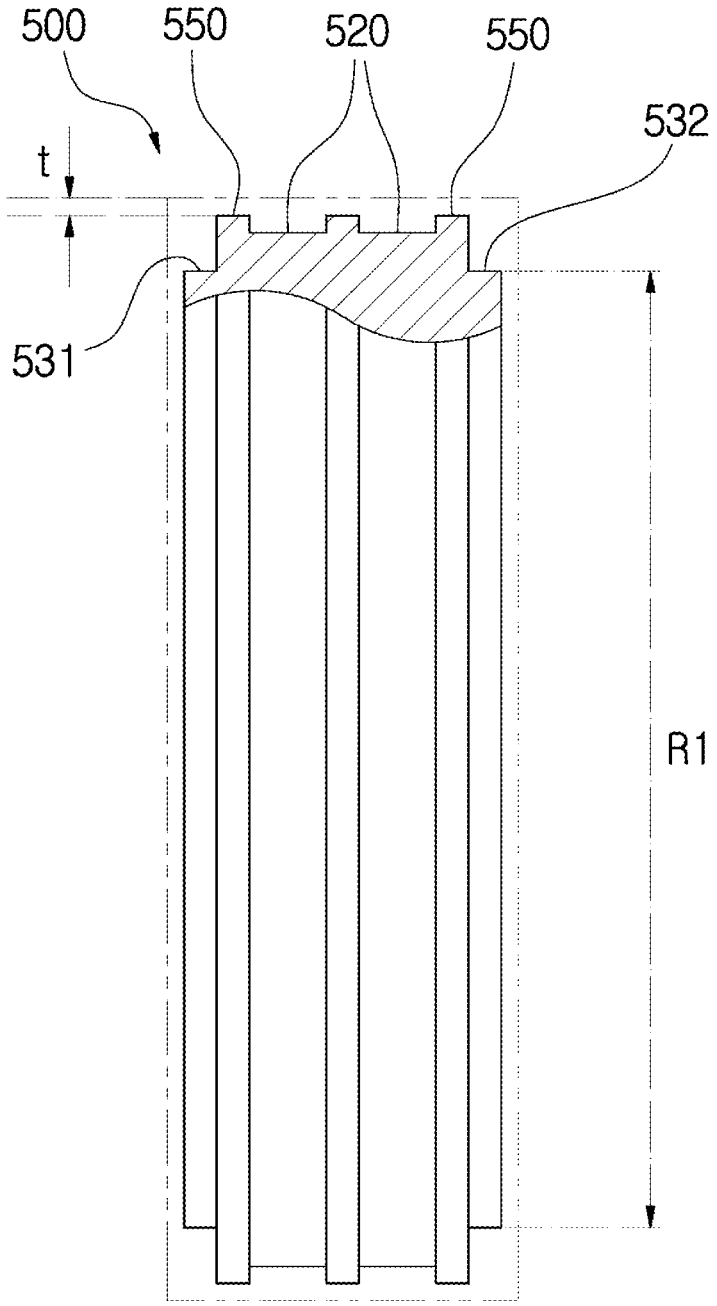

TROCHOID PUMP FOR TRANSFERRING HIGH-VISCOSITY LIQUID UNDER HIGH PRESSURE

CROSS-REFERENCE TO RELATED APPLICATION

This Application is a Section 371 National Stage Application of International Application No. PCT/KR2014/008201, filed Sep. 2, 2014, the contents of which is hereby incorporated by reference in its entirety.

TECHNICAL FIELD

The present invention relates to a trochoid pump for transferring high-viscosity liquids under high pressure, and more particularly, to a trochoid pump having a modified structure in which grooves are provided on inner teeth and outer teeth of the trochoid to increase a gap from a housing so as to lower a viscous friction force of the high-viscosity liquids that are transferred under high pressure, and roller bearings are provided inside the housing to suppress bending of a shaft due to the high pressure that is formed inside the pump.

BACKGROUND OF THE INVENTION

In general, a trochoid pump is a representative displacement pump in which the flow rate is in proportion to the rotating speed of a motor.

The trochoid pump is composed of a rotor connected to a driving shaft of a motor to transfer a rotating force, and an idler coupled to the rotor to be rotated by driving of the rotor. In the trochoid pump, the rotor and the idler are eccentrically provided with a predetermined gap between them to move liquids Korean Registered Patent No. 10-0964517 discloses "oil pump rotor". This patent relates to an oil pump having a trochoid screw thread, which is provided with an inner rotor having outer teeth formed thereon and an outer rotor having inner teeth formed thereon to be engaged with the outer teeth of the inner rotor.

FIG. 1 illustrates a trochoid pump in the related art. The trochoid pump has an external appearance that is similar to that of a gear pump, and is manufactured using the characteristics of a geometric trochoid curve. Unlike the gear pump, the number of inner gear teeth of a rotor is set to be different from the number of outer gear teeth of an idler essentially by one, and the inner gear teeth of the rotor that come in contact with the outer gear teeth of the idler are engaged with the outer gear teeth of the idler while pushing and rotating the outer gear teeth of the idler. Accordingly, the volume between the inner gear teeth of the rotor and the outer gear teeth of the idler is changed to repeat charging and discharging of the transferred liquids.

As illustrated in FIG. 1, a trochoid pump is disclosed, in which the number of outer gear teeth of the idler is 9, and the number of inner gear teeth of the rotor is 8.

On the other hand, the trochoid pump in the related art has the problems that it is required to increase its size and weight in order to transfer the high-viscosity liquids that are gradually increased under high pressure, and thus a large-capacity motor for driving the pump is required to lower the efficiency.

Accordingly, there has keenly been a need for a high-efficiency pump that is miniaturized and light-weighted to transfer high-viscosity liquids using a small-capacity motor.

SUMMARY OF THE INVENTION

Accordingly, the present invention has been made to solve the aforementioned problems occurring in the related art, and one subject to be achieved by the present invention is to provide a trochoid pump, which can achieve high efficiency, miniaturization, and light weight by changing its structure to lower a viscous friction force of high-viscosity liquids between inner teeth and outer teeth of the trochoid pump in the related art so as to be suitable to transfer of the high-viscosity liquids under high pressure, coupling a rotor to a shaft by a spline to heighten the strength of the shaft to correspond to high torque, and providing roller bearings inside the pump to suppress bending of the shall due to the high pressure in the pump.

Technical Solution

To achieve the above and other subjects, in accordance with an embodiment of the present invention, there is provided a trochoid pump, which includes an idler rotatably coupled to an inner through-hole on an inside of a housing, a rotor inserted into an inside of the idler, and a shaft rotating the rotor, wherein the rotor is inserted into the idler and the idler has an inner toothed groove having a plurality of projecting gear teeth formed thereon, and a recessed groove formed on an outer circumference with a predetermined depth in a circumferential direction, and the at least one recessed groove is formed on a center portion of the outer circumference of the idler and front and rear circular grooves are formed at front and rear ends that come in contact with an end portion of the rotor on an outer circumference of the idler, The front and rear circular grooves may be formed to be deeper than the recessed groove.

The outer circumference of the idler may be spaced apart from an inner circumference of the inner through-hole of the housing to form a gap between them.

The rotor may be constructed so that a plurality of inner gear teeth are formed on an outer circumference of the rotor to come in contact with the gear teeth of the idler, a coupling through-hole is formed on a center portion of the rotor to be coupled to the shaft, and a plurality of concave-convex portions are formed on an inner circumference of the coupling through-hole to be spline-coupled to the shaft and a plurality of concave-convex portions are correspondingly formed on an outer circumference of the shaft.

The concave-convex portion may be formed to be recessed inwardly from the front and rear ends of the rotor, and front and rear end gaps may be formed on both sides of the concave-convex portion.

Advantageous Effect

According to the trochoid pump for transferring high-viscosity liquids according to the present invention, unlike the existing gear pump or trochoid pump, the viscous friction force of the high-viscosity liquids can be reduced through the structure having the grooves of the inner rotating body, and the driving power thereof can be reduced by processing and spline coupling to the shaft so as to ensure the strength of the shaft corresponding to a large torque and by applying the roller bearing so as to support the shaft against bending thereof that is caused by the high pressure. In addition, the trochoid pump can be reduced in size and weight so as to be directly mounted on various kinds of robot arms in industry sites, and thus is applicable to various uses with a large variable range of liquid discharge amount.

BRIEF DESCRIPTION OF THE DRAWINGS

The above subjects, other features and advantages of the present invention will become more apparent by describing the preferred embodiments thereof with reference to the accompanying drawings, in which:

FIG. 1 is a view illustrating a trochoid pump in the related art;

FIG. 2 is a perspective view illustrating a rotor and an idler of the trochoid pump in the related art;

FIG. 3 is an exploded perspective view illustrating a trochoid pump according to the present invention;

FIG. 4 is a cross-sectional view illustrating a trochoid pump in a coupled state according to the present invention;

FIG. 5 is a view explaining a viscose friction force due to viscose liquids, which acts on a rotor and an idler in a trochoid pump when the trochoid pump transfers the high-viscosity liquids;

FIG. 6 is an expanded perspective view of a rotor in a trochoid pump according to the present invention;

FIG. 7 is a cross-sectional view conceptually illustrating a coupling structure of FIG. 6;

FIG. 8 is an expanded perspective view of an idler in a trochoid pump according to the present invention; and FIG. 9 is a cross-sectional view conceptually illustrating a coupling structure of FIG. 8.

EXPLANATION OF REFERENCE NUMERALS FOR MAIN PARTS IN THE DRAWINGS

100: housing
110: inner through-hole
200: front guide
300: front body
310: charging port
320: charging flow path
330: discharge port
340: discharge flow path
400: rear body
410: through-hole
500: idler
600: rotor
700: shaft

DETAILED DESCRIPTION OF THE INVENTION

Hereinafter, preferred embodiments of the present invention will be described in detail with reference to the accompanying drawings.

FIG. 3 is an exploded perspective view illustrating a trochoid pump according to the present invention, and FIG. 4 is a cross-sectional view illustrating a trochoid pump in a coupled state according to the present invention. FIG. 5 is a view explaining a viscose friction force due to viscose liquids, which acts on a rotor and an idler in a trochoid pump when the trochoid pump transfers the high-viscosity liquids. FIG. 6 is an expanded perspective view of a rotor in a trochoid pump according to the present invention, and FIG. 7 is a cross-sectional view conceptually illustrating a coupling structure of FIG. 6. FIG. 8 is an expanded perspective view of an idler in a trochoid pump according to the present invention, and FIG. 9 is a cross-sectional view conceptually illustrating a coupling structure of FIG. 8.

As illustrated in FIGS. 3 to 9, a trochoid pump A according to the present invention includes a housing 100, a front guide 200 coupled to a front of the housing 100, a front body 300, and a rear body 400 coupled to the rear of the housing 100, which are successively coupled and penetratingly fastened by a bolt.

The trochoid pump includes an idler 500 rotatably coupled to an inner through-hole 110 on an inside of the housing 100, a rotor 600 inserted into an inside of the idler 500, and a shaft 700 rotating the rotor 600.

The circular inner through-hole 110 is formed in the housing 100, and a plurality of fastening holes 120 are formed on the circumference thereof, to which bolts are fastened.

The front body 300 includes a charging port 310 into which high-viscosity liquids are sucked, a charging flow path 320 formed on one side of an inner portion thereof and connected to the charging port 310, and a discharge flow path 340 and a discharge port 330 formed on the other side of the inner portion thereof.

The charging flow path 320 and the discharge flow path 340 are formed so that one end portion thereof communicates with the inner through-hole 110 of the housing 100, and the other end portion communicate with the charging port 310 and the discharge port 330 formed on an outside of the front body 300. Further, a coupling hole 350 through which the shaft 700 passes is formed in the center portion thereof, and a plurality of fastening holes 360 are formed on the outer circumference thereof to be coupled to bolts.

A through-hole 410 through which the shaft 700 passes to be coupled thereto is formed in the center portion of the rear body 400, and a plurality of fastening holes 420 are formed on the outer circumference thereof to be coupled to bolts.

The idler 500 is coupled to the inner through-hole 110 of the housing 100, and is spaced apart from the inner through-hole 110 for a fine gap t so that the idler 500 can be idled therein.

The rotor 600 is inserted into the idler 500, and the idler 500 has an inner toothed groove 510 having a plurality of projecting gear teeth 511 formed thereon, and a recessed groove 520 formed on an outer circumference thereof with a predetermined depth in a circumferential direction.

The inner toothed groove 510 has gear teeth 511 formed thereon substantially in a star shape, and the number of gear teeth 511 is larger than the number of gear teeth of the rotor by one. At least one recessed groove 520 is formed on the outer circumference of the idler.

Further, front and rear circular grooves 531 and 532 are formed at front and rear ends that come in contact with an end portion of the rotor on the outer circumference of the idler 500.

Preferably, the diameter R1 of the front and rear end circular grooves 531 and 532 is smaller than the diameter of the recessed groove 520.

That is, the front and rear end circular grooves 531 and 532 are formed with the diameter that is smaller than the diameter of the recessed groove 520, and the diameters of the front and rear end circular grooves 531 and 532 are equal to each other.

As illustrated, two recessed grooves 520 are formed, and partitions 550 are formed in the center and on both sides of the recessed grooves 520.

The rotor 600 is constructed so that a plurality of inner gear teeth 610 are formed on the outer circumference of the rotor 600 to come in contact with the gear teeth 511 of the idler 500, a coupling through-hole 620 is formed on the center portion of the rotor 600 to be coupled to the shaft 700, and a plurality of concave-convex portions 630, each of which is composed of a concave portion 631 and a convex portion 632, are formed on an inner circumference of the coupling through-hole 620 to be spline-coupled to the shaft 700, and a plurality of concave-convex portions 720, each of which is composed of a concave portion 721 and a convex portion 722, are correspondingly formed on the outer circumference of the shaft 700.

The number of inner gear teeth 610 of the rotor 600 is set to be smaller than the number of gear teeth 511 of the inner toothed groove 510 of the idler 500 by one, and the diameter of the rotor 600 is smaller than the diameter of the inner toothed groove 510.

The concave-convex portion 630 is formed to be recessed inwardly from the front and rear ends of the rotor 600, and front and rear end gaps 670 and 670' are formed on both sides of the concave-convex portion 630.

According to the present invention, a spline is processed and coupled to the shaft 700 and the boss of the rotor 600 to correspond to high torque. According to the pump in the related art, various types of keys are generally inserted and coupled to rotate the rotor 600, and thus in the case of transferring the high-viscosity liquids under high pressure, high-resistance torque is loaded on the shaft according to the characteristics thereof to cause the occurrence of damage. However, according to the present invention, the coupling of the rotor 600 to the shaft 700 in the high-viscosity trochoid pump under this pressure can be firmly maintained through the spline coupling.

In the related art, since the idler 500 and the housing 100 are in a close gap state, high pressure is generated and leakage of the liquids can be prevented.

However, in the case of the high-viscosity liquids, the viscose friction force (shear force) that is caused by the viscosity is increased as the gap between the idler and the housing becomes closer, and thus resistance torque on the shaft is heightened, and the capacity of the motor is increased.

As illustrated in FIG. 5, during transferring of the high-viscosity liquids, the high-viscosity liquids in the form of a thin film generate the shear force due to relative motion of the rotor 600 and the idler 500 against the fixed housing on the surface wet with the liquids, and this causes resistance torque to be generated to disturb the rotation.

In this case, since the viscose friction force is in proportion to the fourth power of the rotation radius, higher-capacity motor is required as the size of the motor is increased. Further, since the viscose friction force becomes larger as the gap between the housing and the rotating body becomes smaller, it is required to set an enough gap except for a specific portion, for example, a portion in which the leakage of the liquids is suppressed.

In order to solve this problem, according to an embodiment of the present invention, the recessed groove 520 is processed so that a wide gap that corresponds to several times the gap is formed on the remaining surface except for the minimum range for preventing the leakage of the liquids, and thus the viscose friction force is greatly lowered.

In particular, since the side surface portion of the idler 500 having the largest rotation radium has a wide contact surface with the housing 100 and thus the highest viscose friction force is generated, the recessed groove 520 is formed so that the contact area is minimized and the remaining portion corresponds to several times the close gap, and thus the viscose friction force (shear force) can be lowered.

The operation of the present invention as constructed above will now be described.

The power of the motor (not illustrated) connected to the shaft 700 is transferred to the shaft 700 to rotate the shaft 700, and thus the rotor 600 is driven to rotate.

As illustrated in FIG. 1, if the rotor 600 is rotated in a state where the inner gear teeth 610 of the rotor 600 is somewhat smaller than the inner toothed groove 510 of the idler 500 and the number of the inner gear teeth is smaller than the number of grooves by one, the inner gear tooth 610 pushes and compresses the gear teeth of the inner toothed groove 510, and thus the idler 500 is rotated at low speed.

Although the viscose friction force (shear force) acts on the rotating surface of the rotor 600 and the outer circumference of the idler 500, the idler 500 according to the present invention has the recessed grooves 520 and the front and rear end circular grooves 531 and 532 formed on the outer circumference of the idler, and thus the viscose friction force can be reduced.

In the same manner, since the rotor 600 is spline-coupled to the shaft 700 and the concave-convex portion 630, firm coupling becomes possible, and thus the rotor can endure a load that is generated when the high-viscosity liquids are rotated at high speed under high pressure to prevent damage.

Although the present invention has been described with reference to the preferred embodiment in the attached figures, it is to be understood that various equivalent modifications and variations of the embodiments can be made by a person having an ordinary skill in the art without departing from the spirit and scope of the present invention as recited in the claims.

INDUSTRIAL APPLICABILITY

According to the trochoid pump for transferring high-viscosity liquids according to the present invention, the viscous friction force of the high-viscosity liquids can be reduced through the structure having the grooves of the inner rotating body, and the driving power thereof can be reduced by processing and spline coupling to the shaft so as to ensure the strength of the shaft corresponding to a large torque and by applying the roller bearing so as to support the shaft against bending thereof that is caused by the high pressure. In addition, the trochoid pump can be reduced in size and weight so as to be directly mounted on various kinds of robot arms in industry sites, and thus is applicable to various uses with a large variable range of liquid discharge amount.

What is claimed is:

1. A trochoid pump comprising:

an idler rotatably coupled to an inner through-hole on an inside of a housing, a rotor inserted into an inside of the idler, and a shaft rotating the rotor, wherein the rotor is inserted into the idler and the idler has an inner toothed groove having a plurality of projecting gear teeth formed thereon, and at least one recessed groove formed on an outer circumference with a predetermined depth in a circumferential direction;

wherein the at least one recessed groove is formed on a center portion of the outer circumference of the idler, and front and rear circular grooves are formed at front and rear ends of the idler at the outer circumference of the idler, wherein the front and rear circular grooves are above an end portion of the rotor contacted by the idler;

wherein the front and rear circular grooves are formed to be deeper than the at least one recessed groove.

2. The trochoid pump according to claim 1, wherein the outer circumference of the idler is spaced apart from an inner circumference of the inner through-hole of the housing to form a gap between them.

3. The trochoid pump according to claim 1, wherein the rotor is constructed so that a plurality of rotor gear teeth are formed on an outer circumference of the rotor to come in contact with the gear teeth of the idler, a coupling through-hole is formed on a center portion of the rotor to be coupled to the shaft, and a plurality of first concave-convex portions are formed on an inner circumference of the coupling through-hole to be spline-coupled to the shaft and a plurality of second concave-convex portions are correspondingly formed on an outer circumference of the shaft.

4. The trochoid pump according to claim 3, wherein the plurality of first concave-convex portion are formed to be recessed inwardly from the front and rear ends of the rotor, and front and rear end gaps are formed on both sides of the concave-convex portion.

* * * * *